US006564768B2

(12) United States Patent
Bauer et al.

(10) Patent No.: US 6,564,768 B2
(45) Date of Patent: May 20, 2003

(54) AIR INTAKE SYSTEM FOR AN INTERNAL COMBUSTION ENGINE

(75) Inventors: Sascha Bauer, Auenwald (DE); Thomas Haubold, Marbach (DE); Michael Kolmeder, Dingolfing (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/984,003

(22) Filed: Oct. 26, 2001

(65) Prior Publication Data

US 2002/0059912 A1 May 23, 2002

(30) Foreign Application Priority Data

Oct. 26, 2000 (DE) ..... 100 53 148

(51) Int. Cl.[7] ..... F02B 77/00
(52) U.S. Cl. ..... 123/198 E; 55/385.3; 180/68.3
(58) Field of Search ..... 123/198 E; 180/68.3; 55/385.3; 73/335.05

(56) References Cited

U.S. PATENT DOCUMENTS 3,870,008 A 3/1975 Wilkerson

FOREIGN PATENT DOCUMENTS

| | | | |
|---|---|---|---|
| CH | 682183 | 7/1993 | |
| DE | 3736777 | * 12/1988 | ..... 123/198 E |
| DE | 19613860 | 10/1997 | |
| DE | 19730188 | 1/1999 | |
| JP | 04365965 | 12/1992 | |

* cited by examiner

*Primary Examiner*—Noah P. Kamen
(74) *Attorney, Agent, or Firm*—Crowell & Moring LLP

(57) ABSTRACT

An intake system for an internal combustion engine of a motor vehicle, which includes a first air intake 10, which is arranged at a point in the motor vehicle that is advantageous for air intake, and a second air intake 11, which is arranged at a point that is protected from road spray and splashes of water. The two air intakes 10, 11 end in a common line 12 that communicates with the internal combustion engine. In the first air intake 10, a moisture sensor 14 is arranged. When water enters into the first air intake 10, this moisture sensor emits a signal that actuates a solenoid 23 to move a pivotable valve 13. In a first switching position pivotable valve 13 closes the second air intake 11 so that no air reaches line 12 from the second air intake 11. In a second position (shown in broken lines) pivotable valve 13 closes the first air intake 10 so that air reaches line 12 only through the second air intake 11.

10 Claims, 5 Drawing Sheets

AIR INTAKE SYSTEM FOR AN INTERNAL COMBUSTION ENGINE

BACKGROUND OF THE INVENTION

The invention relates to an intake system for an internal combustion engine of a motor vehicle.

German patent no. DE 196 13 860 discloses an air intake filter unit for an internal combustion engine of a motor vehicle with a tubular space that is connected to a main intake and a secondary intake via intake lines. A sealing device that can alternately close one intake line and open the other intake line is provided in addition. This sealing device is moved by means of an actuating element in such a way that the sealing device closes the main intake and opens the secondary intake when the motor vehicle is immersed in water. This actuating element is operatively linked with a slide valve. The slide valve is arranged in a tube, which is open along its lower end, and is sealed relative to said tube. The slide valve is operatively linked with a permanent magnet. The sealing device is operatively linked with an additional permanent magnet. This permanent magnet of the sealing device is rotatable relative to the permanent magnet of the actuating element.

The disadvantage of this embodiment is that the tube, which is arranged in the engine compartment, requires a considerable amount of space. The tube may not be made too small since the switching point of the arrangement can otherwise not be precisely defined. This mechanical switching arrangement furthermore responds only if the vehicle is immersed into standing water. In case of road spray, the pressure that builds up is insufficient for switching, so that water reaches the intake tract and impairs the functioning of the engine.

SUMMARY OF THE INVENTION

It is an object of the invention to provide an air intake system that can be integrated into a small space.

Another object of the invention is to provide an air intake system that prevents snow, road spray or gushes of water from entering the air intake.

These and other objects are achieved by the invention as described and claimed hereinafter.

The intake system for an internal combustion engine of a motor vehicle according to the invention has a first air intake and a second air intake for raw (i.e., unfiltered) air. These two air intakes are combined into a common line, which line communicates with the internal combustion engine. The two air intakes may also be combined directly in front of the internal combustion engine, in which case each air intake has its own components, e.g., its own filter element. Each air intake comprises an opening through which air can flow into the intake system and a line segment, which connects this opening with the line or with other components arranged between the line and the air intake. The air intakes can be closed off with a closure element or valve member, so that air reaches the line communicating with the internal combustion engine through either the first air intake or the second air intake. The valve member completely blocks the respective air intake, so that air can flow into the line only through the unblocked air intake. The valve member can be formed, for instance, by a rotary body with corresponding openings. This rotary body opens the first air intake in one end position and closes the first air intake in a second end position.

The incoming air is either directly or indirectly guided to the internal combustion engine through the line communicating with the internal combustion engine. If the air is indirectly guided to the internal combustion engine, it can be pretreated, e.g., dried or cooled. If the air is directly guided to the internal combustion engine, no further component is arranged in the line.

The first air intake is disposed at a point in the motor vehicle that is advantageous for air intake. The front area is a preferred location since impact pressure is created as a function of the vehicle speed and the air is pressed into the air intake, which improves the filling ratio of the cylinders. Furthermore, the air that is sucked in from the front area is cooler than the air present in the engine compartment. In the front area, however, snow, ice, road spray or splashes of water may also reach the first air intake. Road spray is defined as air mixed with water droplets of any size. Road spray can for example be splashed up from the road by a vehicle traveling ahead or can be produced by rain. The term gushes of water describes a larger amount of water, which may occur in the form of larger splashes or a surge of water, for instance as may be encountered in fording a river. The second air intake is arranged at a point in the vehicle that is less favorable for air intake but is protected against road spray and splashes of water. Preferred locations to arrange this second air intake can for instance be the engine compartment or the ventilation system.

To actuate the valve member, a drive unit connected to a control element is provided. This drive unit can be embodied, for instance, as an electric motor or a vacuum unit and can be actuated by means of the control element. This causes the drive unit to execute a rotary or linear movement that moves the valve member from a first end position to a second end position and thereby seals either the first or the second air intake. The control element is embodied as a moisture sensor with a signal output to control the drive unit. This moisture sensor can of course also be used for feedback control.

The moisture sensor may be adjusted in such a way that it sends a signal to the drive unit even if there is road spray, which already impairs the functioning of the internal combustion engine. This signal causes the first air intake to be closed. At another setting of the moisture sensor, the signal for closing the first air intake is emitted only if the moisture sensor is surrounded by water. The signal of the moisture sensor can be sent to the drive unit either directly or via an electronic element, e.g., the motor control. As soon as the first air intake is closed by the valve member, the second air intake is opened, whereby the internal combustion engine receives combustion air sucked in through the second air intake.

In an advantageous embodiment of the invention the valve member is a pivotable valve. This pivotable valve can for instance be circular, oval or rectangular, so that it closes the second air intake in a first position and the first air intake in a second position. The pivotable valve can be arranged centrally on a valve shaft and can be moved by a rotary movement of the valve shaft. In other embodiments, the valve shaft is arranged along an edge area so as to provide an air intake that is free from interfering contours. To prevent penetration of water into the first air intake, particularly in case of immersion into a body of water, the pivotable valve may be provided with a circumferential seal. Other embodiments are feasible, in which a first pivotable valve is arranged in the first air intake and a second pivotable valve in the second air intake. The two pivotable valves are connected so that they communicate with one another. As soon as the first pivotable valve changes its position, the second pivotable valve also moves, so that one air intake is always open while the other one is closed. This communicating connection of the pivotable valves can be mechanical, e.g., using a strut, or electronic, using a signal that is emitted particularly by the moisture sensor.

In one specific embodiment, the pivotable valve has two pivotable valve parts that are correspondingly connected with one another. These pivotable valve parts can be arranged at a defined angle relative to one another. They can either contact one another directly or be rigidly connected by means of connecting elements. The parallel arrangement of the pivotable valve parts relative to one another represents a special embodiment. The pivotable valve parts can also be locally separated, however, and correspond with one another only via the drive unit. The pivotable valve parts can for instance have a circular, oval or rectangular cross section with one pivotable valve part sealing one air intake. The pivotable valve parts may be provided with a circumferential seal to close the air intakes tightly. If pivotable valve parts are used to close the air intakes, said air intakes can end in the common line in various ways.

The drive unit can for instance be a solenoid that communicates with the moisture sensor. This solenoid can execute an axial or radial motion to move the valve member. As soon as the moisture sensor detects water it sends a signal to the solenoid, which causes the solenoid to move and thus the valve member to change its position. The solenoid responds to the signal within fractions of a second whereby the first air intake is closed before water can penetrate and reach the internal combustion engine. As is generally known, solenoids have an anchor, a spring, a coil, a yoke and an electrical connection.

The moisture sensor is formed by at least two electrically conductive sensor wires spaced at a distance from one another. These electrically conductive sensor wires are made of a material that has low electrical resistance and is therefore a good electrical conductor, e.g., metals or metal alloys. The sensor wires spaced at a distance from one another may extend parallel or at an angle to one another. The sensor wires can have any cross section, e.g., circular or rectangular, and even very small cross sections are possible, e.g., in the range of 0.01 $mm^2$. These small sensor wire cross sections can be created, for example, by applying a metal to a substrate by means of vapor deposition. The two sensor wires are correspondingly connected with an evaluation unit, which can emit a signal to control the drive unit. As soon as a defined current flow between the two sensor wires is exceeded, the evaluation unit generates the signal to close the first air intake.

According to a further embodiment of the invention, the electrically conductive sensor wires are deposited on a substrate, said sensor wires being either embedded in the substrate or placed on top of it. The substrate is made of a material that in its dry state insulates the conductive sensor wires from one another. This material may be designed to absorb water, whereby it becomes electrically conductive. In another embodiment of the substrate, the substrate material is not capable of absorbing water, so that the water is separated in the form of droplets on the substrate. Such a droplet then bridges the electrically insulating substrate material and connects the sensor wires with one another to create a current flow that causes the first air intake to be closed.

In another specific embodiment of the invention, the moisture sensor is arranged in a plane with the first air intake. It can be arranged at a location remote from the air intake, which chiefly comes into contact with water. The valve member is disposed above the moisture sensor at a defined distance, so that a sufficient response time remains between the detection of water and the closing of the first air intake. The moisture sensor is preferably arranged in a location within the engine compartment. As a result it detects the environmental conditions within the engine compartment. When the vehicle drives through water, the moisture sensor is immersed into the standing water simultaneously with the air intake and immediately causes the first air intake to be closed by the valve member, which is arranged at a higher point. Arranging the moisture sensor in the same plane as the first air intake prevents any premature closing of the first air intake, which would occur if the moisture sensor were arranged at a lower point.

In a further embodiment of the invention the moisture sensor is arranged within the first air intake. As a result, the moisture sensor detects exactly the conditions prevalent within the first air intake. It causes the first air intake to be closed by the valve member as soon as water enters the first air intake. The valve member is disposed downstream from the moisture sensor. The distance between the valve member and the moisture sensor is such that after detection of water a sufficient response time remains to close the first air intake before water can flow past the valve member and reach the internal combustion engine. Arranging the moisture sensor within the first air intake ensures that said first air intake is closed only if water actually enters the first air intake. The air is thus taken in via the first air intake, which is more favorable for the internal combustion engine, and the first air intake is closed and air sucked in via the second air intake only if water actually penetrates the first air intake.

In yet another variant of the invention, the moisture sensor can be integrated into the valve member.

According to a further embodiment of the invention, the intake system has a filter element with a filter medium and the moisture sensor is integrated into the filter element. The filter element is inserted into a filter housing in such a way that an untreated area is separated from a treated area forming a tight seal. On the untreated-air side the filter housing communicates with the first and the second air intake. On the treated side, the filter housing communicates with the internal combustion engine. An intake air manifold, which distributes the treated air to the individual cylinders of the internal combustion engine, can be arranged between the internal combustion engine and the filter housing. It is of course also possible to provide two air filters, with one air filter being arranged in each untreated air line. The treated air regions are then combined into a common line.

Since the moisture sensor is integrated into the filter element, it is replaced at the same time as the filter element. Thus, the moisture sensor can be altered through aging processes only within the replacement interval, which ensures that the moisture sensor is highly reliable. The filter element may comprise only the filter medium, e.g., a nonwoven filter material. In other embodiments the filter element has several components, e.g., a combination of a filter medium and an enclosure. This enclosure can be used, for instance, as a seal or a stabilizing frame. The filter element can have any form, but an embodiment as a flat element, particularly a rectangular flat element, or a hollow cylinder is advantageous. The filter medium may be a filter paper, particularly a coated or treated filter paper. The filter medium can, for example, be flat or folded.

In one particular embodiment, the electrically conductive sensor wires of the moisture sensor are connected directly with the filter medium. The sensor wires can for example be glued or woven into the filter medium or cast into the paper pulp during paper production, whereby the precise condition of the filter medium is detected. With increasing penetration of moisture into the filter element, the airflow resistance of the filter medium increases, so that the internal combustion engine receives less air for combustion. In addition, the filter medium, after it can no longer absorb any more water, releases this water on the filtered side, so that water can penetrate into the internal combustion engine. It is therefore advantageous to detect the penetration of moisture into the filter element, so that based on the condition of the filter a signal can be sent from the evaluation unit to the drive unit causing the first air intake to be closed by the valve member.

The sensor wires can be arranged on the filter medium in any form. If the filter medium is folded, the sensor wires can extend longitudinally, diagonally or perpendicularly to the folds and can extend either along a folding edge of the folds or along a surface of the folds. Care must be taken in each of these embodiments, however, that the sensor wires have sufficient non-insulated contact with the filter medium. Furthermore, the sensor wires can be arranged on the untreated or the treated side. If the sensor wires are arranged on the treated side they are protected against dirt. Furthermore, the sensor wires should preferably be arranged at a point on the filter element where the greatest possible penetration of moisture can be expected. This makes it possible to close the first air intake when moisture has penetrated only into this area, while the rest of the filter element is still capable of absorbing water. The smaller the distance between the sensor wires, the less moisture it takes to produce a sufficient current flow, which sends the signal to close the first air intake.

According to a further embodiment of the invention, the filter housing has voltage contacts to supply the moisture sensor with voltage. These voltage contacts can be arranged at any point in the filter housing. The moisture sensor can, for instance, be arranged directly within the filter space of the filter housing or outside this filter space. Since the filter housing is at least partly a stationary component, the arrangement of the voltage contacts on the filter housing can save cables and mounts for the moisture sensor. Also feasible are embodiments in which the sensor wires are connected with the filter housing in such a way that they contact the filter element. When the filter housing is opened, the sensor wires are lifted from the filter element. After a new filter element has been installed, the filter housing is closed again causing the wires to rest against the filter element. As a result, only the used filter element is replaced and all other components can continue to be used.

It is advantageous that the moisture sensor has voltage connections that are inserted into a seal extending around the filter medium. This makes it possible to supply the moisture sensor with voltage by mounting the filter element in the filter housing. The voltage connections can for instance be externally applied to the seal, with corresponding contacts being provided within the filter housing. In this embodiment, the filter element is inserted into the filter housing whereby the contacts of the filter element touch the contacts of the filter housing and thus supply the sensor wires with voltage. A further option to arrange the voltage connections within the seal is to insert the voltage connections into the interior of the seal, which is accomplished when the sealing material is applied.

An advantageous embodiment of the invention provides for the arrangement of a plurality of moisture sensors. For instance, two identically constructed moisture sensors may be provided. These moisture sensors may also be arranged at different locations within the motor vehicle. Also feasible is the use of dissimilar moisture sensors that differ, for instance, with respect to the distance between the sensor wires or the voltage supply. The moisture sensors can be arranged directly side by side or at different locations within the motor vehicle. In one possible arrangement, for example a highly sensitive moisture sensor can be arranged within the first air intake and an insensitive moisture sensor within the engine compartment below the first air intake. This makes it possible to configure different switching variants. As soon as the insensitive moisture sensor is immersed in water it can output the signal to close the first air intake although the highly sensitive moisture sensor has not yet had any contact with water. In a further variant, both moisture sensors come into contact with road spray. The insensitive moisture sensor does not yet emit a signal while the highly sensitive moisture sensor already detects a threshold value.

It is advantageous that the operability of the moisture sensor can be tested upon start of the internal combustion engine. A moisture sensor test that verifies the operability of the moisture sensor takes place as soon as the internal combustion engine is started to ensure that the moisture sensor is indeed operable when required. This operability can be tested, for instance, by a reference value, which is stored in the evaluation unit. To display the status of the moisture sensor for the operator of the internal combustion engine, the moisture sensor may be connected e.g., to a control light, which is extinguished after the sensor test if the sensor operates correctly. If the sensor test is negative and the moisture sensor does not operate as specified, the control light may blink, for example, or be steadily lit. Thus, the operator is informed that the intake system does not operate properly and the first air intake may possibly fail to close in case of water so that for instance driving through water should be avoided and the intake system should be serviced as soon as possible.

In another specific embodiment of the inventive concept, the operability of the drive unit and the valve member can be tested upon start of the internal combustion engine. The drive unit and the valve member are moved each time when the internal combustion engine is started, so that all parts are operable when needed and are not frozen, for instance due to corrosion. The testing of the drive unit and the valve member can be indicated e.g., by a control light, which is extinguished only after successful movement.

These and other features of preferred embodiments of the invention, in addition to being set forth in the claims, are also disclosed in the specification and/or the drawings, and the individual features each may be implemented in embodiments of the invention either alone or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
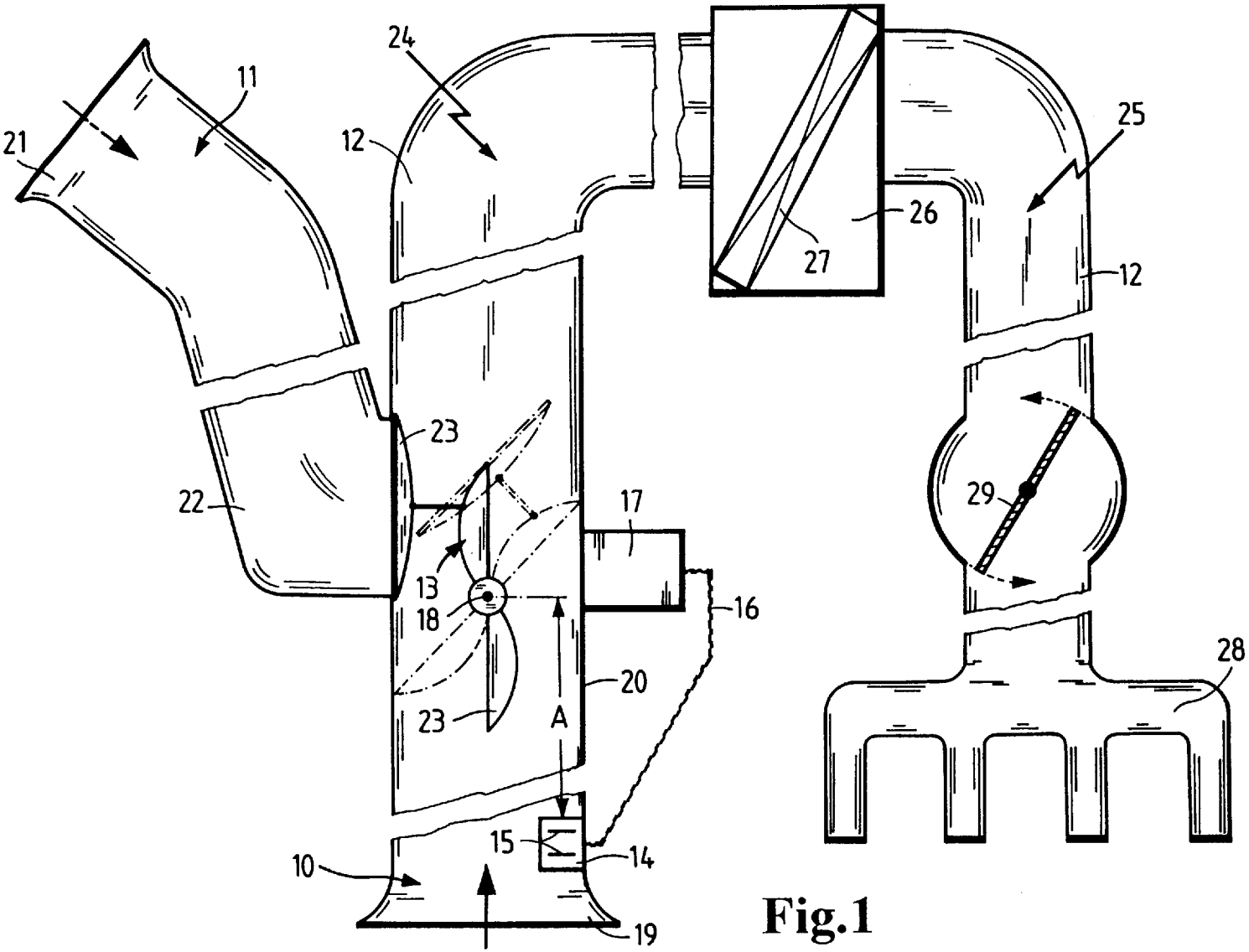
FIG. 1 is a schematic view of an intake system according to the invention.

FIG. 1 schematically depicts an intake system. This intake system has a first air intake 10 and a second air intake 11. These air intakes 10, 11 end in a common line 12, which is correspondingly connected with an internal combustion engine (not shown). Furthermore, a pivotable valve 13 is arranged within the intake system such that either the first air intake 10 or the second air intake 11 is correspondingly connected with line 12. In a first pivotable valve position, which is the basic position, the second air intake 11 is separated from line 12, so that air can enter line 12 only through the first air intake 10. In a second pivotable valve position (shown in broken lines) the first air intake 10 is separated from line 12 by pivotable valve 13, so that air can reach line 12 only through the second air intake 11. In this embodiment, the first air intake 10 forms a single part with line 12 without any transition, and pivotable valve 13 defines the end of the first air intake 10 and the beginning of line 12. The second air intake 11 also forms a single part with line 12. This second air intake 11 ends in line 12 at a 90□ angle. In other embodiments, the first and the second air intake 10, 11 may have a multipart design with line 12 and may end in line 12 at different angles.

To detect whether water or snow has entered the intake system, a moisture sensor 14 is provided and arranged in the first air intake 10. As soon as the moisture sensor 14, formed essentially by two electrically conductive sensor wires 15, comes into contact with water or snow, an electric current flows between the sensor wires. This causes a signal to be emitted from moisture sensor 14 to a solenoid 17 by means of a switching amplifier via a connecting line 16. Due to this signal, solenoid 17 produces a movement by which pivotable valve 13 is moved into its second position (broken line). In this second position, the first air intake 10 is closed and the second air intake 11 is opened. Pivotable valve 13, which is provided with a valve shaft 18, is connected with the solenoid 17 whereby valve shaft 18 is rotated and pivotable valve 13 is moved from its first position into its second position (indicated by the broken lines).

The first air intake 10 is formed by a first opening 19 with a first line segment 20 adjoining said first opening 19. Moisture sensor 14 is arranged at a distance A from pivotable valve 13 so that after moisture sensor 14 has detected water and pivotable valve 13 has been closed, no water has yet flown past pivotable valve 13 into line 12. Distance A is defined in such a way that the water, during the response time that elapses between detection of water by the moisture sensor 14 and closure of the first air intake 10, can continue to penetrate into the first air intake 10 without reaching line 12, which is correspondingly connected with the internal combustion engine. Until the water arrives at pivotable valve 13, which forms the transition to line 12, pivotable valve 13 must remain closed. Thus, in the second position (shown in broken lines), when pivotable valve 13 closes the first air intake 10, the water can penetrate at maximum up to pivotable valve 13 but cannot reach line 12.

The second air intake 11 is formed by a second opening 21 and a second line segment 22. The second opening 21 is disposed at a point in the motor vehicle that is protected from road spray and splashes of water, located for instance above the first opening 19. The line segments 20, 22 can follow any three-dimensional curves within the motor vehicle, so that the intake system can be adapted to the engine compartment.

In this illustrative embodiment, the pivotable valve 13 comprises two pivotable valve parts 23. These pivotable valve parts 23 are rigidly connected with one another. In the first position one pivotable valve part 23 closes the second air intake 11. In the second position (broken line) the other pivotable valve part 23 closes the first air intake 10 and unblocks the second air intake 11.

Line 12 has an untreated area 24 and a treated area 25. Between the untreated area 24 and the treated area 25 a filter housing 26 is arranged into which a filter element 27 is inserted so as to form a seal, whereby the treated area 25 is sealed off from the untreated area 24.

The air cleaned by the filter element 27 is supplied to an intake air manifold 28 in the treated area 25 of line 12. A throttle valve 29 is used to regulate the air supply of the intake air manifold 28 as a function of the operating states of the internal combustion engine.

Figure 2:
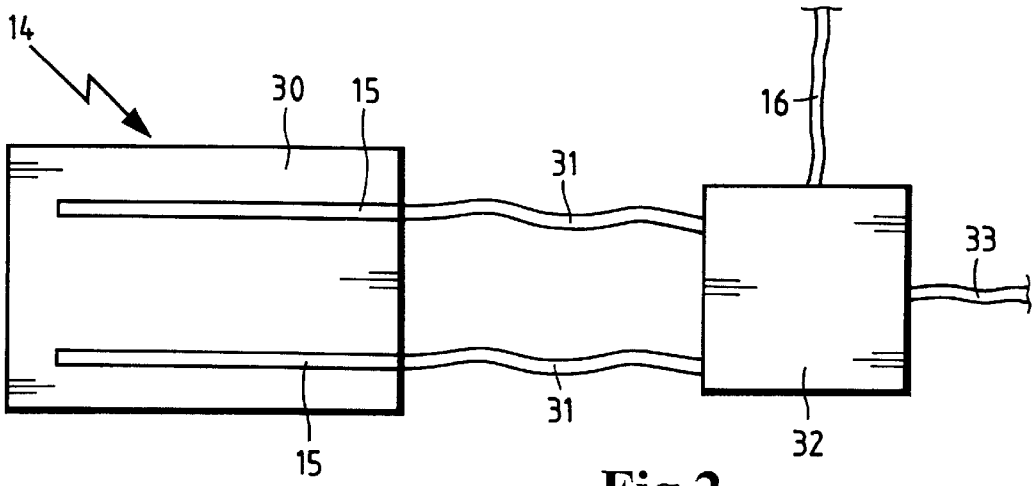
FIG. 2 depicts a moisture sensor useful in the intake system of the invention.

FIG. 2 shows a moisture sensor 14. This moisture sensor 14 has two electrically conductive sensor wires 15, which are arranged on a substrate 30. Substrate 30 is made of a material with electrically insulating properties, e.g., plastic. Substrate 30 does not absorb water, so that an electrical current can flow between the sensor wires only after the sensor wires 15 have been immersed in water. This moisture sensor thus responds only in case of splashes of water. The two sensor wires 15 each have a separate lead 31 connecting said sensor wires 15 to an evaluation unit 32. The evaluation unit 32 has a current lead 33 that connects the moisture sensor 33 to a voltage source (not shown). The evaluation unit 32 determines the current consumption of the sensor wires 15. As soon as the current consumption of the sensor wires 15 exceeds a defined value, the evaluation unit 32 sends a signal via connecting lead 16 to a drive unit (not shown), which moves the valve member (not shown) and thus causes the first air intake (not shown) to be closed.

Figure 3:
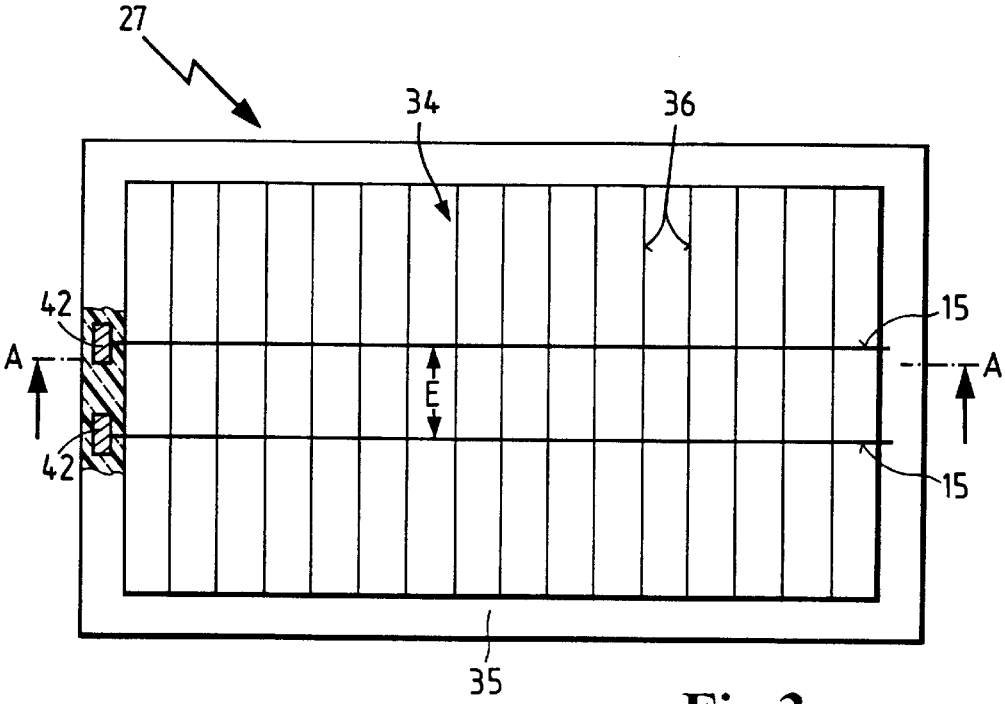
FIG. 3 depicts a filter element.

FIG. 3 shows a filter element 27 with an integrated moisture sensor 14. This filter element 27 has a filter medium 34 consisting of a filter paper with zigzag shaped folds 36 and a seal 35 arranged circumferentially around the filter medium 34. The moisture sensor 14 has two electrically conductive sensor wires 15 that are in direct contact with the filter medium 34. The electrically conductive sensor wires 15 extend perpendicularly to folds 36 and parallel to one another and are arranged at a defined distance E from one another. The sensor wires 15 are each connected with a contact 42. This contact 42 is arranged on seal 35. Contact 42 consists of a rectangular metal plate that adjoins voltage contacts (not shown) arranged on the housing side.

Figure 4:
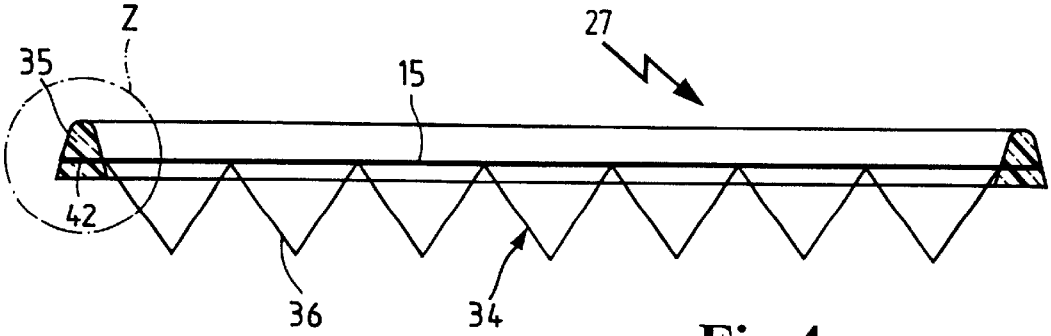
FIG. 4 is a cross section of a filter element taken along section line A—A in FIG. 3.

FIG. 4 shows a cross section of a filter element corresponding to section line A—A according FIG. 3. In this embodiment the sensor wires 15 contact the filter medium 34 only by the tips of the folds 36. The contacts 42 of the sensor wires 15 are embedded in seal 35, so that no contour protrudes over seal 35 which might impair the tightness of the filter element 27 within the filter housing (not shown).

Figure 5:
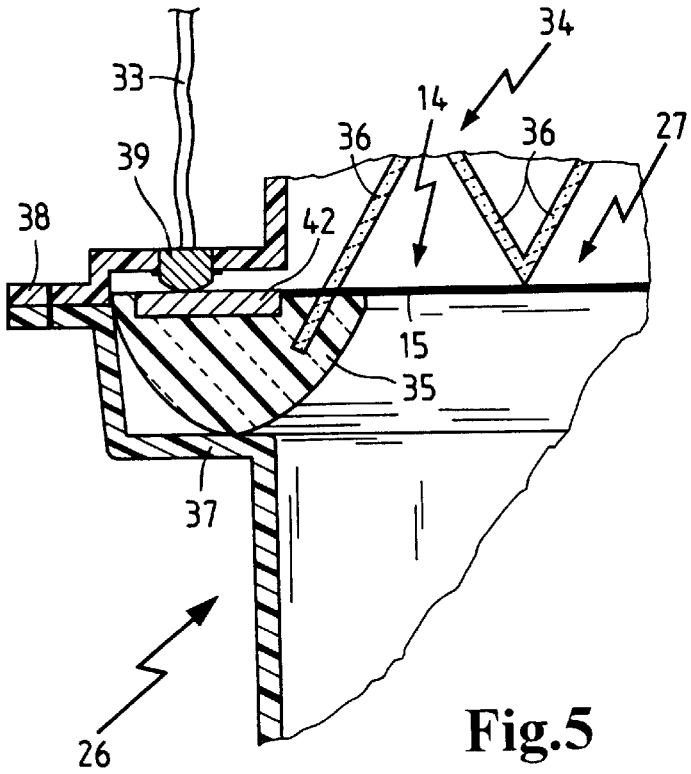
FIG. 5 is a detail Z according to FIG. 4.

FIG. 5 depicts a detail Z according to FIG. 4 in which the filter element 27 is depicted in its installed state inside filter housing 26. The filter housing 26 has a lower part 37 and an upper part 38. With its seal 35 the filter element 27 rests against the lower part 37. The sensor wires 15 and the contacts 42 are arranged on the side opposite the lower part 37. The upper part 38 is connected to the lower part 37 so as to form a seal. Voltage contacts 39, which directly contact contacts 42 are provided in the upper part 38 and thus apply a voltage to the sensor wires. The voltage contacts 39 are connected to a current lead 33, which in turn is connected to a voltage source (not shown).

Figure 6:
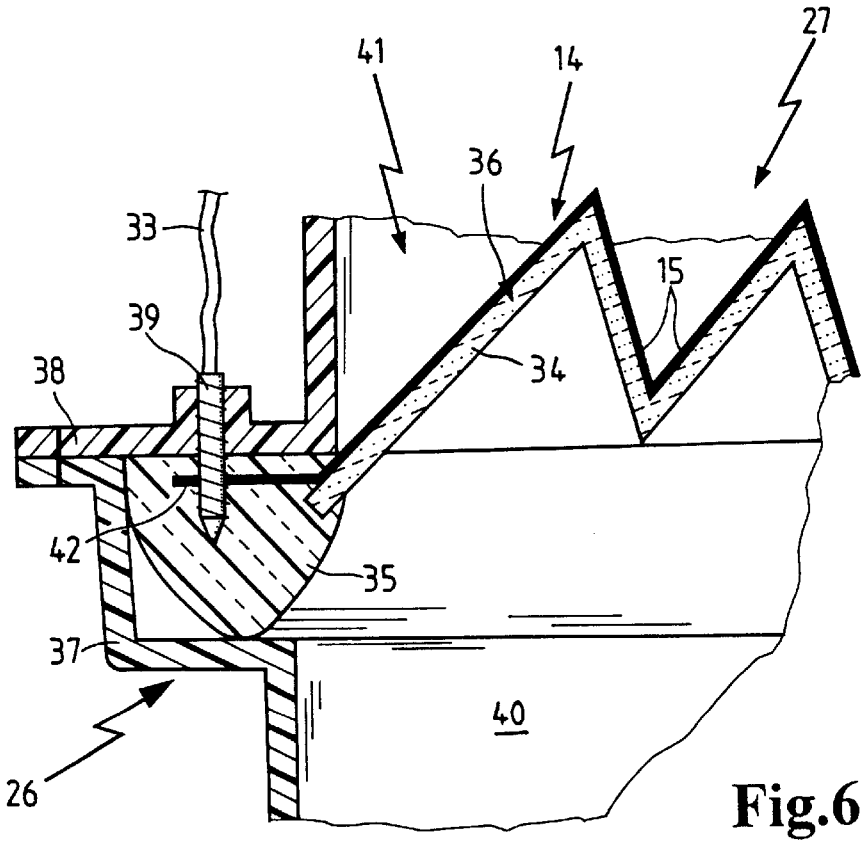
FIG. 6 is a variant of detail Z according to FIG. 4.

FIG. 6 shows a variant of a detail Z according to FIG. 4 in which the filter element 27 is depicted in its installed state inside the filter housing 26. Components corresponding to those of FIG. 5 are identified by the same reference numerals. In this example the electrically conductive sensor wires 15 are made of aluminum and extend along folds 36 so that they are in maximum contact with the filter medium 34. Inside the filter housing, the filter element 27 inside filter housing 26 separates a treated side 40 from an untreated side 41 so as to form a seal. The sensor wires 15 are arranged on the untreated side 41. They come into direct contact with the moisture and moisture sensor 14 can cause the first air intake (according to FIG. 1) to be closed immediately. In this embodiment, the contacts 42 of the sensor wires 15 are arranged in the interior of seal 35, whereby the contacts 42 are insulated all around. The voltage contacts 39 of the filter housing 26 penetrate seal 35 and pierce contacts 42 of the sensor wires 15 to produce an electrical contact between contacts 42 and voltage contacts 39.

Figure 7:
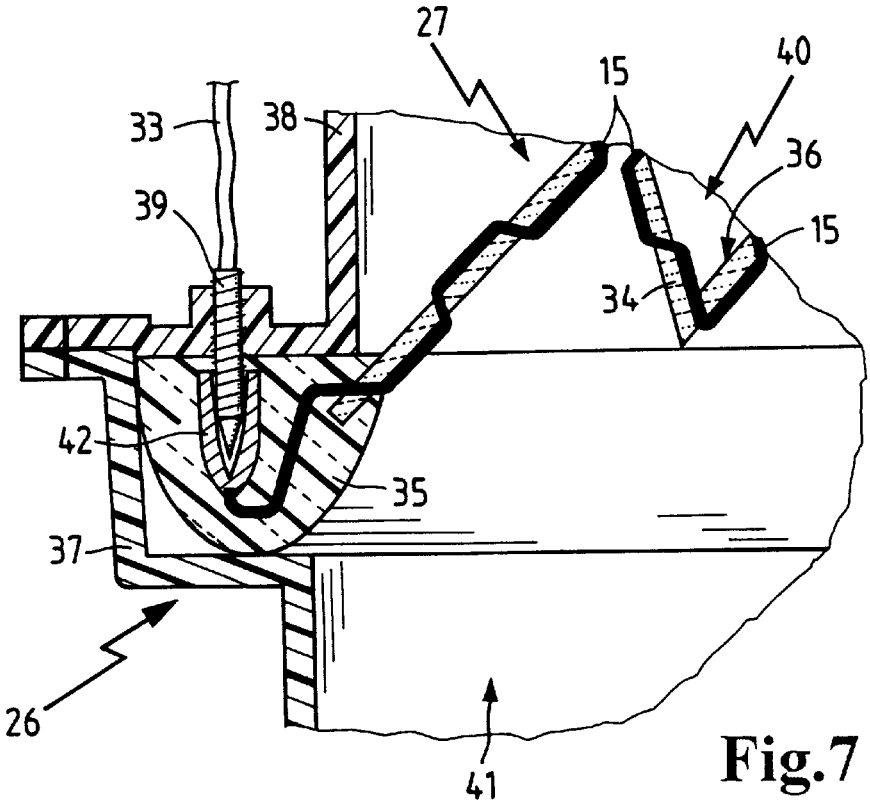
FIG. 7 is another variant of detail Z according to FIG. 4.

FIG. 7 shows a variant of a detail Z according to FIG. 4 in which the filter element 27 is depicted in its installed condition inside filter housing 26. Components corresponding to FIG. 5 are provided with identical reference numerals. In this embodiment the sensor wires 15 are woven through filter medium 34 whereby the sensor wires 15 are in contact with both the treated side 40 and the untreated side 41. Sensor wires 15 are connected to contacts 42, which are completely surrounded by seal 35. Contacts 42 are configured as clamping contacts, with voltage contacts 39 of filter housing 26 penetrating seal 35 and engage contacts 42. To prevent errors when the filter is replaced, the filter element 27 is symmetrical in design so that a connection between voltage contacts 39 and contacts 42 is produced even if the filter element 27 is rotated by 180°.

Figure 8:
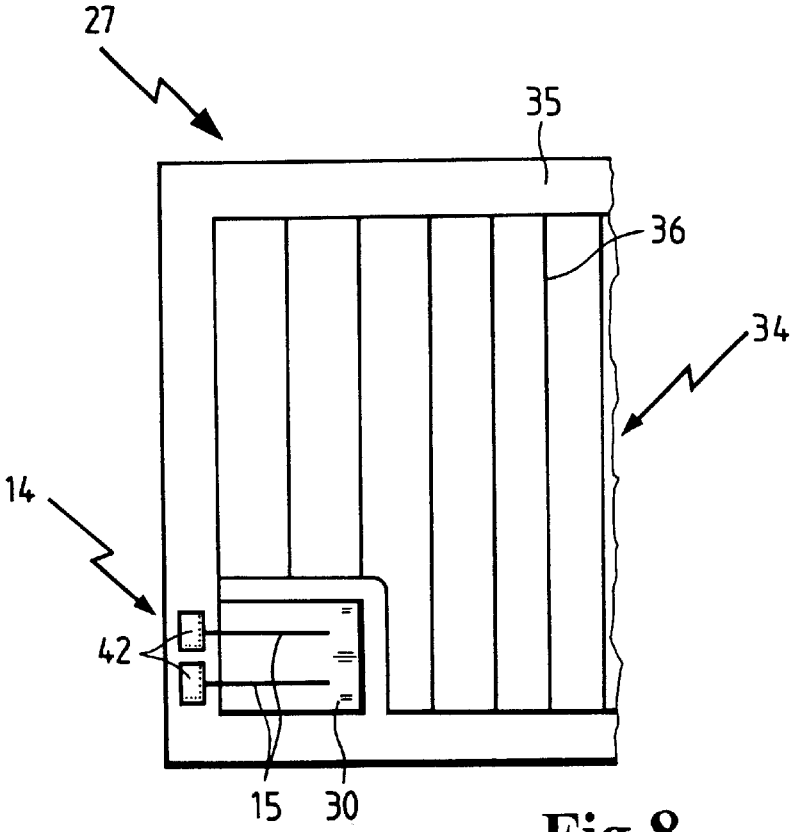
FIG. 8 is a partial view of a filter element.

FIG. 8 depicts a partial view of a filter element wherein the moisture sensor 14 is arranged in a partial area of filter element 27. Seal 35 is configured in such a way that it encloses moisture sensor 14 and fixes it in position. The sensor wires 15 are applied to a substrate 30 that is electrically insulating in its dry state and is capable of absorbing water, whereby it becomes conductive. In this embodiment the sensor wires are not in direct contact with the filter medium 34.

Figure 9:
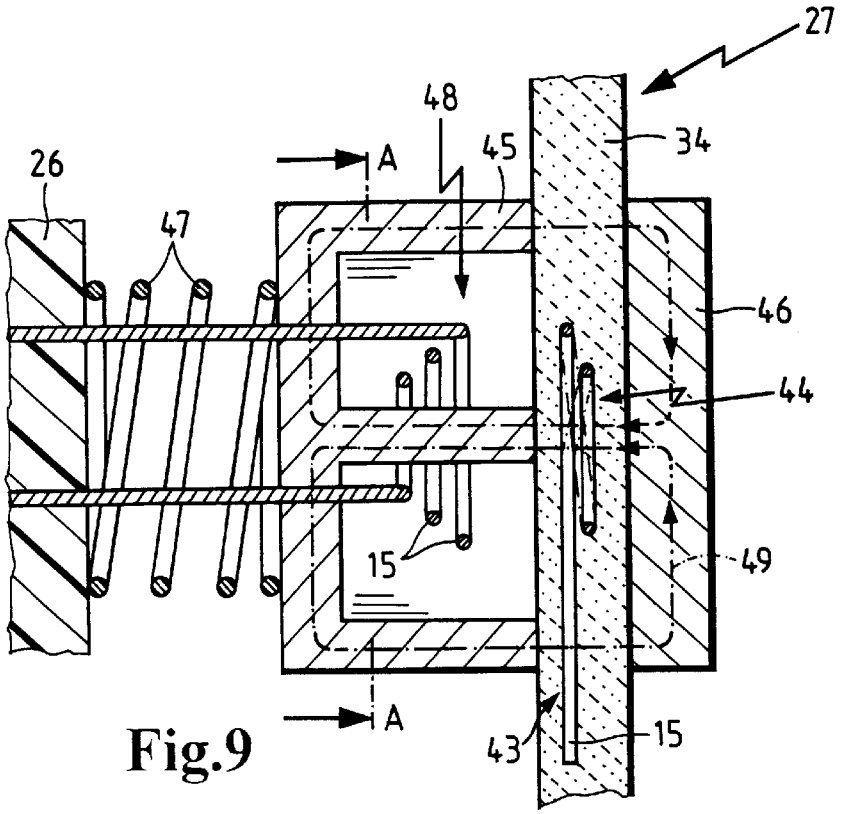
FIG. 9 is a variant of a detail Z according to FIG. 4.
Figure 10:
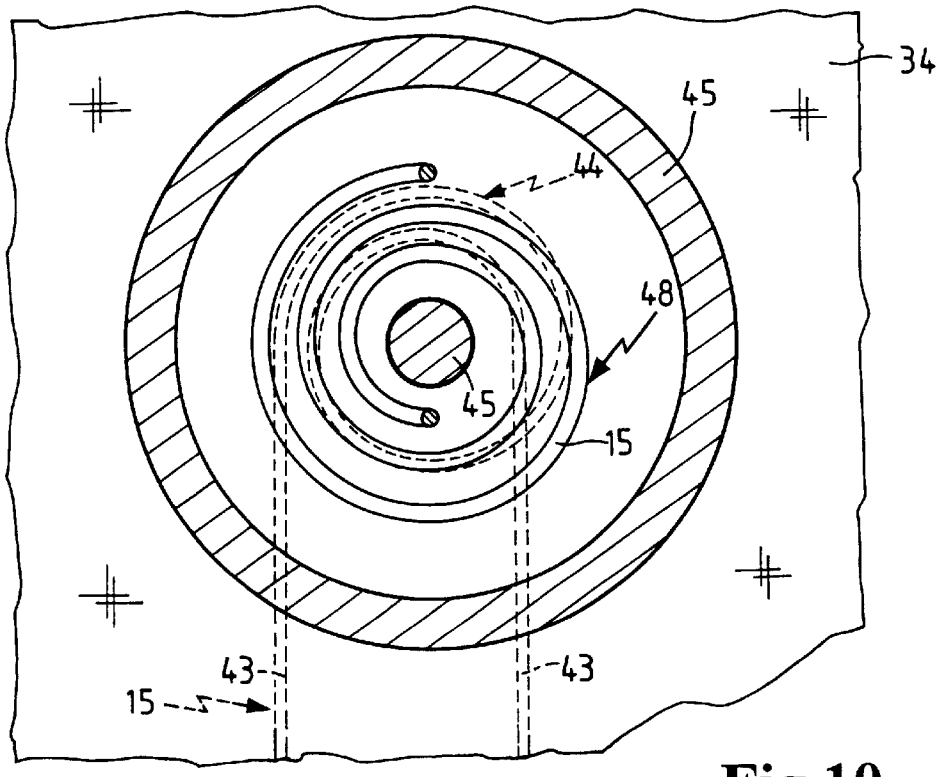
FIG. 10 is a partial section corresponding to section line A—A according to FIG. 9.

FIG. 9 is a variant of a detail Z according to FIG. 4. Moisture in the filter medium 34 is detected according to the transformer principle. In this embodiment the filter medium 34 is a filter paper into which an electrically conductive sensor wire 15 was cast during filter paper production. As shown in FIG. 10, sensor wire 15 has two legs 43 extending in parallel and a secondary winding area 44. The secondary winding area 44 has a diameter of approximately 10 to 20 mm.

A cup-type ferrite core 45 is placed onto the filter medium 34. Opposite said ferrite core 45, on the other side of the filter medium 34, a ferrite disk 46 is arranged. This ferrite disk 46 and ferrite core 45 are made of a higher-frequency magnetically conductive material. This material is made for example of very fine iron shavings that are cast into a synthetic resin or plastic. The ferrite core 45 is pressed against the filter medium 34 by a spring 47. To this end, the spring is supported against the filter housing 26. The spring 47 is pretensioned such that the ferrite core 45 is not lifted from filter medium 34 even if there are vibrations. Within ferrite core 45 an additional electrical sensor wire 15 is arranged. This sensor wire 15 has a primary winding area 48, the diameter of which essentially corresponds to the diameter of the secondary winding area 44. It is also feasible, however, that the diameters of winding areas 44, 48 differ in size. In other embodiments, the sensor wire 15 with primary winding area 48 is integrated into the filter housing 26. The primary winding area 48 is connected to an alternating voltage source (not shown) in which case an alternating voltage of e.g., 50 kHz can be applied. The alternating voltage in sensor wire 15 with the primary winding area 48 generates an alternating magnetic field 49 in ferrite core 45 in conjunction with ferrite disk 46. Ferrite disk 46 serves to close the alternating magnetic field 49 and to minimize the scattering losses of the alternating magnetic field 49. It is advantageous that the ferrite disk 46 has essentially the same outside diameter as ferrite core 45.

Sensor wire 15, which is integrated into filter medium 34, has no voltage supply. As a result, as long as filter medium 34 is dry and not electrically conductive, the alternating magnetic field does not change. As soon as the filter medium 34 becomes moist and electrically conductive, a current flows in sensor wire 15 with the secondary winding area 44, which causes an increase in the current in sensor wire 15 with the primary winding area 48. This current increase is detected by an evaluation unit (not shown) and sends a signal to close the first air intakes 10 according to FIG. 1.

FIG. 10 depicts a partial section corresponding to section line A—A according to FIG. 9. Components corresponding to those of FIG. 9 are provided with the same reference numerals.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. An air intake system for an internal combustion engine of a motor vehicle, comprising a first air intake, a second air intake, a valve member, a drive unit and a filter element having a filter medium, wherein the filter element is installed in a filter housing such that the filter element separates an untreated air area from a treated air area, the second air intake is arranged at a point that is protected from road spray and splashes of water, the first air intake and the second air intake communicate with a common line which in turn communicates with the internal combustion engine, the valve member can be moved by the drive unit between a first position in which it closes the second air intake and a second position in which it closes the first air intake, the drive unit is connected with a control element by which the drive unit can be actuated, the control element comprises a moisture sensor integrated into the filter element, the moisture sensor is formed by at least two electrically conductive sensor wires spaced a distance from one another, and the moisture sensor has a signal output for controlling the drive unit.

2. An air intake system according to claim 1, wherein the electrically conductive sensor wires are applied to a substrate.

3. An air intake system according to claim 1, further comprising a filter element having a filter medium, said filter element being installed in a filter housing such that the filter element separates an untreated air area from a treated air area, wherein the moisture sensor is integrated into the filter element.

4. An air intake system according to claim 1, wherein the electrically conductive sensor wires of the moisture sensor are directly connected with the filter medium.

5. An air intake system according to claim 1, wherein the filter housing is provided with voltage contacts which engage the moisture sensor on the filter to supply the moisture sensor with a voltage.

6. An air intake system according to claim 5, wherein the moisture sensor has a voltage supply that is accommodated in a seal extending around the filter medium, and the voltage contacts of the filter housing are connected with the voltage supply of the moisture sensor.

7. An air intake system according to claim 6, wherein the voltage contacts of the filter housing penetrate the seal of the filter element.

8. An air intake system according to claim 1, wherein the moisture sensor has a voltage supply that is accommodated in a seal extending around the filter medium.

9. An air intake system according to claim 1, wherein the first sensor wire has a primary winding arranged in a ferrite core which in turn rests against the filter medium, and the second sensor wire is inserted into the filter medium in a central area, said second sensor wire having two parallel extending legs which are connected to a secondary winding.

10. An air intake system according to claim 1, wherein a plurality of moisture sensors are provided.

* * * * *